US008087130B2

(12) United States Patent
Chan

(10) Patent No.: US 8,087,130 B2
(45) Date of Patent: Jan. 3, 2012

(54) FASTENER

(75) Inventor: Man Chan, Hong Kong (CN)

(73) Assignee: NIFCO (HK) Ltd., Hong Kong (CN)

( * ) Notice: Subject to any disclaimer, the term of this patent is extended or adjusted under 35 U.S.C. 154(b) by 790 days.

(21) Appl. No.: 12/171,702

(22) Filed: Jul. 11, 2008

(65) Prior Publication Data

US 2009/0276983 A1 Nov. 12, 2009

(30) Foreign Application Priority Data

May 7, 2008 (CN) ..... 2008 2 0112532 U

(51) Int. Cl.
*A44B 13/00* (2006.01)

(52) U.S. Cl. ..... 24/369; 24/265 H

(58) Field of Classification Search ..... None
See application file for complete search history.

(56) References Cited

U.S. PATENT DOCUMENTS 1,889,633 A * 11/1932 Butterworth ..... 24/116 R
4,224,722 A * 9/1980 Mikosz et al. ..... 24/601.5

* cited by examiner

*Primary Examiner* — Jack W. Lavinder
(74) *Attorney, Agent, or Firm* — Oblon, Spivak, McClelland, Maier & Neustadt, L.L.P.

(57) ABSTRACT

The present invention is directed to a fastener having a curved end and a head away from the curved end, wherein an object can be hooked up at the curved end, the head being provided with a narrower passage for a cord to pass through and a wider passage for a tape to pass through, the cord and the tape being used to connect to the same subject or separately to different subjects.

2 Claims, 4 Drawing Sheets

FASTENER

FIELD OF THE INVENTION

The present invention is directed to a fastener, in particular a fastener for fastening: 1. an object, 2. a cord, tape or the like of an article (such as the cord on apparel or backpack).

DESCRIPTION OF THE RELATED ART

Fasteners used to catch, drag, suspend and fasten something by its curved end(s). Usually, an object is hooked up at the curved end and a cord would connect to the hole at the head of the fastener that the other side of the cord is linked with another object as to hang the fastener for catching things.

However, sometimes, the cord is hard to be linked when there are more than one objects need to be connected with the head of the fastener for fastening at the same time. Also, in the existing models of fastener, there is only one hole for one type of string at the head, which means that, it is inconvenient for users to pass through a tape or cord if the hole is not made for the specific type of strings.

SUMMARY OF THE INVENTION

The object of the present invention is to provide a new type of fastener, which can overcome the above-mentioned drawbacks of the prior art fastener.

The present invention provides a fastener, including a curved end and a head away from the curved end, wherein an object can be hooked up at the curved end, the head being provided with a narrower passage for a cord to pass through and a wider passage for a tape to pass through, the cord and the tape being used to connect to the same subject or separately to different subjects.

The present invention aims to provide an extra area for an option to fasten an extra object to the head of the fastener if necessary. Users can choose a tape or a cord for the linkage depending on their needs, which the tape would be more easily to pass through since the size of the extra area is customized for a tape. Also, even if there are two objects needed to connect to the head of the fastener at the same time, they can be fastened by a cord and a tape separately for the linkage. Hence, it is much more convenient for the users to use the fastener for fastening.

BRIEF DESCRIPTION OF THE ACCOMPANYING DRAWINGS

The invention will now be described in greater detail by preferred embodiments with reference to the accompanying drawings, in which FIG. 1 shows a prior art fastener, the head of which is fastened to a cord;

DETAILED DESCRIPTION OF THE PREFERRED EMBODIMENTS

Figure 1:
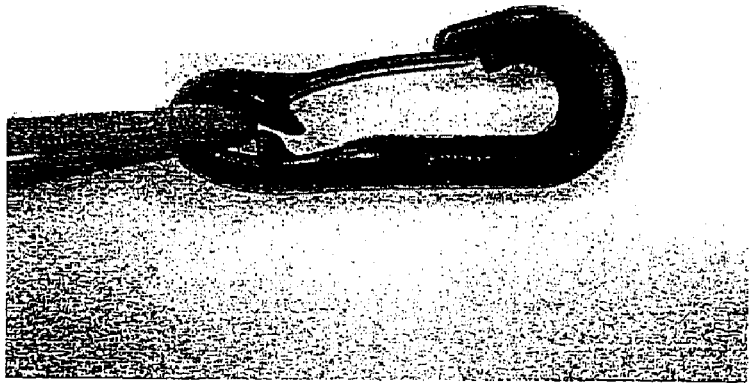
Fig. 1 PRIOR ART
Figure 2:
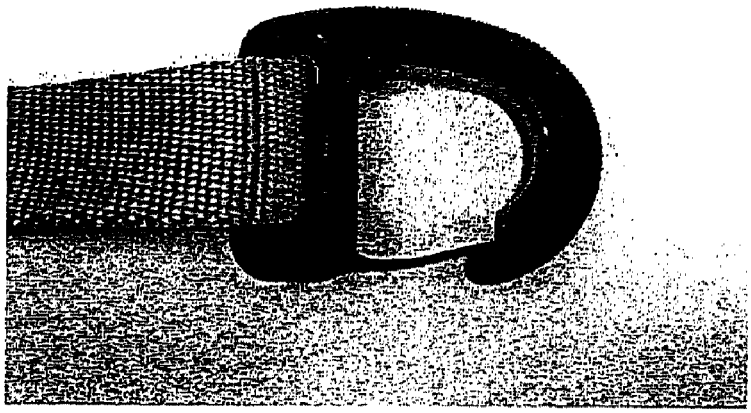
Fig. 2 PRIOR ART
FIG. 2 shows a further prior art fastener, the head of which is fastened to a taper.

FIGS. 1 and 2 show two types of prior art fastener, respectively. In FIG. 1, a cord is connected to the passage at the head of the fastener. In FIG. 2, a tape is connected to the passage at the head of the fastener. In another word, in the existing models of fastener, there is only one passage for one type of string at the head. Thus, it is inconvenient for users to pass through a tape or cord if the passage is not made for the specific type of strings.

Figure 3:
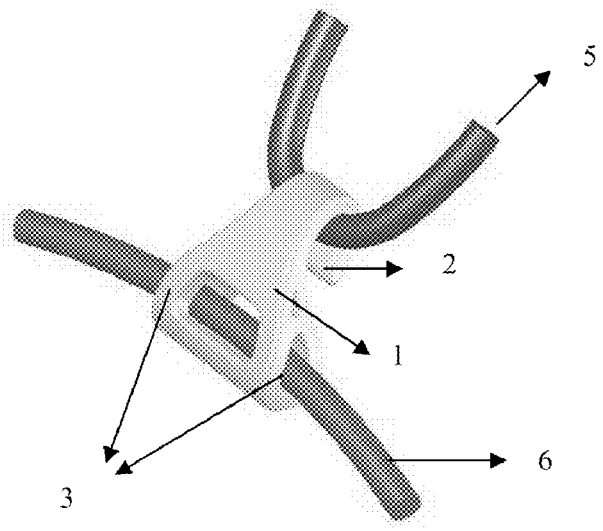
FIG. 3 shows a preferred embodiment of the fastener of the present invention, the head of which is fastened to a cord.
Figure 4:
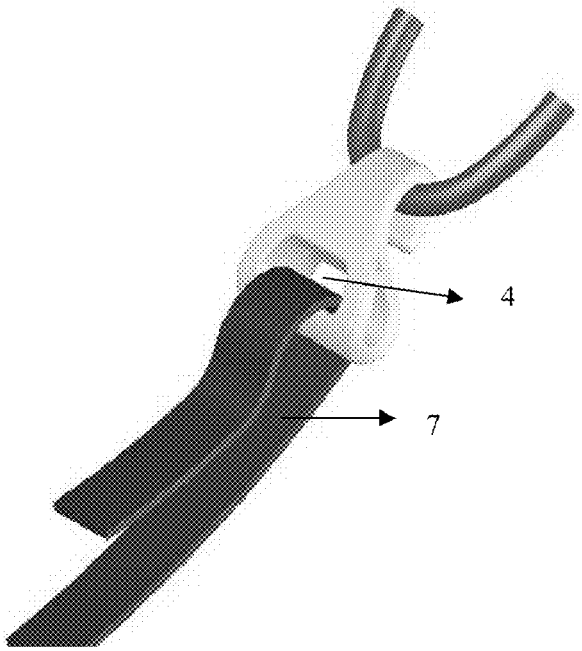
FIG. 4 shows the preferred embodiment of the fastener of the present invention, the head of which is fastened to a taper.

FIGS. 3 and 4 show a preferred embodiment of the fastener 1 of the present invention, including a curved end 2 and a head away from the curved end 2. An object, such as a cord 5 as shown in FIG. 3 may be hooked up at the curved end. It should be understood that such object can be any object as desired. The head of the fastener is provided with two passages, one narrower passage 3 and one wider passage 4. The narrower passage 3 allows a cord 6 to pass through, as shown in FIG. 3. The cord 6 may be connected to a subject so as to hold it. The wider passage 4 allows a tape 7 to pass through, as shown in FIG. 4. The tape 7 may be connected to a subject so as to hold it. It should be understood that the cord 6 and the tape 7 may be connected to the same subject, or be separately connected to different subjects. The subjects connected to the cord 6 or the tape 7 may be any subject as desired.

The orientation of the narrower passage 3 and the wider passage 4 may be provided according to specific applications. In some case, for instance, the narrower passage 3 and the wider passage 4 may be provided to be perpendicular to each other.

Preferably, the narrower passage 3 and the wider passage 4 extend through each other, as shown in FIGS. 3 and 4. In this case, the volume of the fastener is decreased and the production material for the fastener is saved. Thus the cost of the fastener will be decreased. In addition, the fastener becomes more flexible with pretty appearance.

As desired, the fastener may be made of materials such as plastic, metal and so on.

Figure 5:
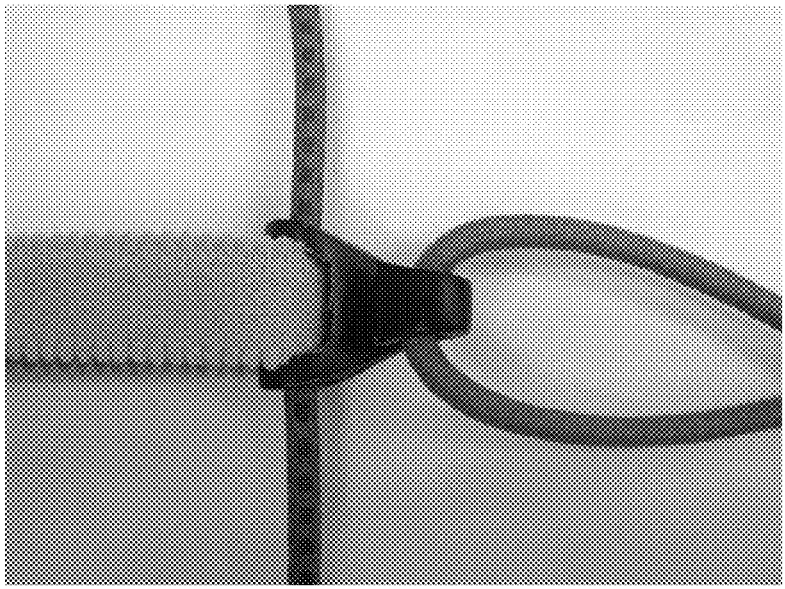
FIG. 5 shows the preferred embodiment of the fastener of the present invention, the head of which is fastened to both a cord and a taper.

Three application status of the present fastener are shown in FIGS. 3-5, respectively. In FIG. 3, a cord 5 is hooked up at the curved end 2 of the fastener 1 and another cord 6 is passed through the narrower passage 3 at the head of the fastener 1. In FIG. 4, a cord 5 is hooked up at the curved end 2 of the fastener 1 and a tape 7 is passed through the wider passage 4 at the head of the fastener 1. In FIG. 5, a cord 5 is hooked up at the curved end 2 of the fastener 1 and another cord 6 and a tape 7 are passed through the narrower passage 3 and the wider passage 4 at the head of the fastener 1 respectively. It is apparent that it is convenient for the user to pass a cord or a tape or both through the passages at the head.

Figure 6:
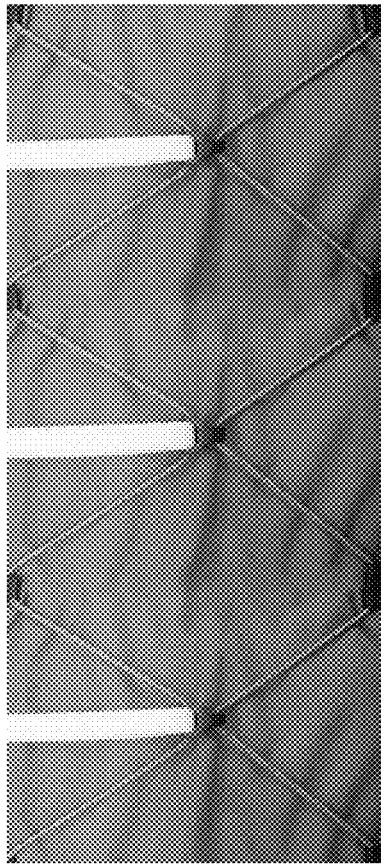
FIG. 6 shows an application of the fastener of the present invention to a backpacker.

Also, it is popular to find a cord in intersecting pattern being placed on the front side of backpacks for protecting the cover of the backpacks to not fall down, and reshaping the backpacks to be slimmer by tightening the cord, as shown in FIG. 6. By using the fastener in this application, more different patterns would be made depending on users' demands. Therefore, it would be easier to change patterns by releasing the curved end of the fastener from the cord for reshaping the backpacks.

Figure 7:
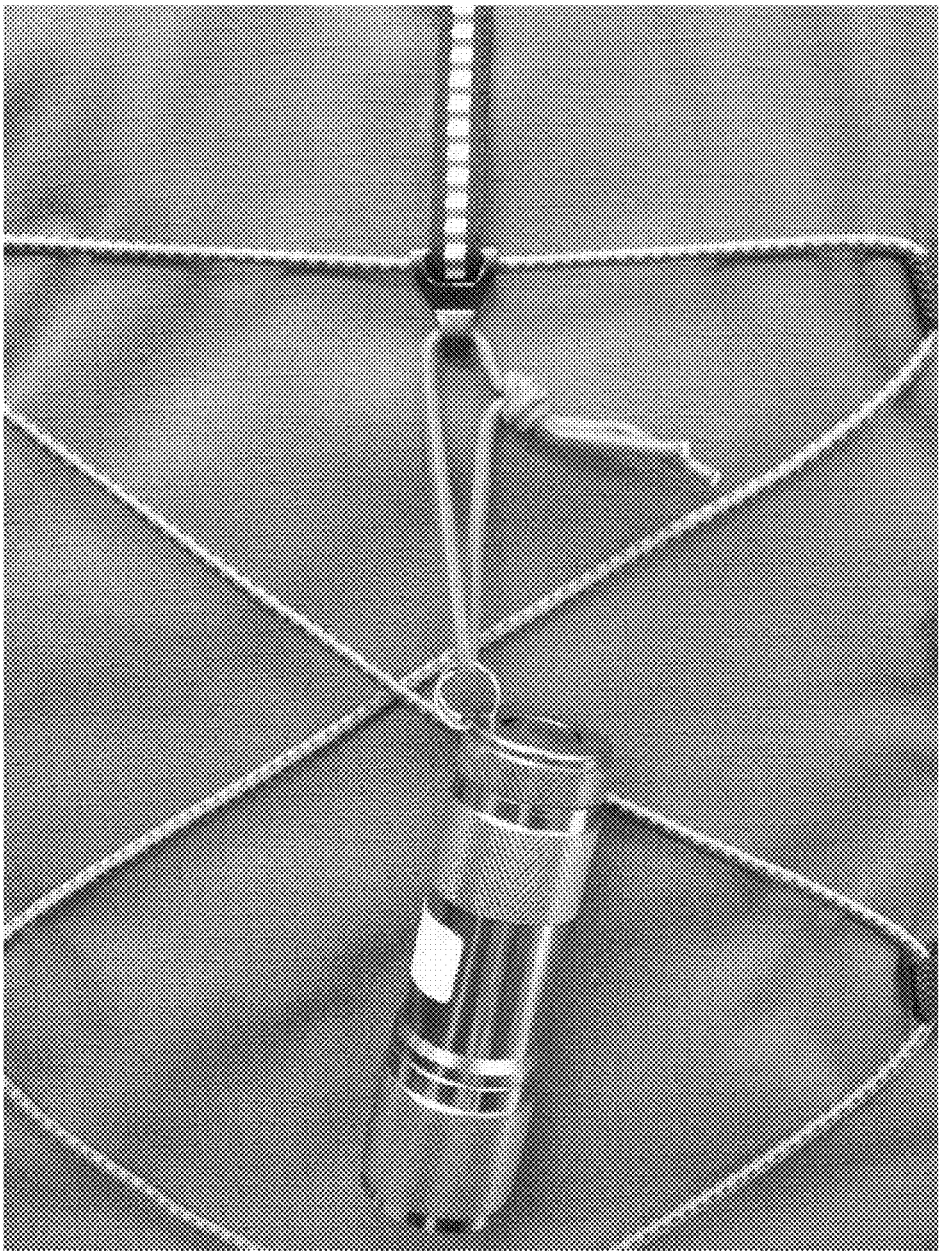
FIG. 7 shows another application of the fastener of the present invention to a backpacker.

In addition, sometimes, object in a certain weight would be hold between the cover and the cord in intersecting pattern. However, the objects may fall due to overweight. In this way, a fastener is preferably to be used for bearing heavier objects. FIG. 7 is one of the examples for the invention. The fastener can hook up an object firmly and not to fall easily since there are two strings, i.e. the cord and the tape, passed through the head of the fastener as to bear more weights.

There have been described several embodiments of a fastener of the present invention. While the invention has been described with reference to specific embodiments, the description is illustrative of the invention and is not to be construed as limiting the invention. Various modifications and applications may occur to those skilled in the art without departing from the true spirit and scope of the invention as defined in the appended claims.

What claimed is:

1. A fastener, comprising:

a curved end; and a head away from the curved end, wherein an object can be hooked up at the curved end, the head being provided with a narrower passage for a cord to pass through and a wider passage for a tape to pass through, the cord and the tape being used to connect to the same subject or separately to different subjects, and wherein a longitudinal axis of the narrower passage and a longitudinal axis of the wider passage are oriented perpendicular to each other.

2. The fastener of claim 1, wherein the narrower passage and the wider passage extend through each other.

* * * * *